United States Patent [19]

Phillips

[11] 3,981,167

[45] Sept. 21, 1976

[54] DIRECT-DIAL COMBINATION LOCK

[76] Inventor: Peter J. Phillips, 828 Calle De Arboles, Redondo Beach, Calif. 90277

[22] Filed: Dec. 5, 1974

[21] Appl. No.: 529,699

[52] U.S. Cl. ..... 70/311
[51] Int. Cl.[2] ..... E05B 37/04
[58] Field of Search ..... 70/305, 308, 311

[56] References Cited

UNITED STATES PATENTS

| | | | |
|---|---|---|---|
| 1,308,521 | 7/1919 | Butter | 70/311 |
| 2,775,113 | 12/1956 | Behrens | 70/133 |

*Primary Examiner*—Robert Wolfe
*Assistant Examiner*—Al Craig
*Attorney, Agent, or Firm*—Poms, Smith, Lande & Glenny

[57] ABSTRACT

A combination lock has a plurality of gated tumbler wheels mounted for rotation relative to a gate entering bar portion of a release lever, blocking a release movement of such lever until gate openings on the tumbler wheels are aligned to said bar and a tumbler locator and lever arm actuator member mounted for both axial and rotative movement relative the axis of rotation of the tumbler wheels. The member has a drive pin engaging, and successively releasable from, drive apertures divided in the tumbler wheels to allow rotation of the tumbler wheels upon rotation of the member and sequential release of located tumbler wheels upon an axial movement of said member relative to said tumbler wheels. A portion of the release lever rides upon a smooth cylindrical exterior surface of the member, preventing engagement of the lever associated bar with any of the tumbler wheels, and the gate openings, until the member has been moved axially into a tumbler wheel release location which aligns interengaging means between the member and the lever in order to operate the latter upon further rotation of the member. A dial assembly and means for selectively adjusting the axial position of the member are also provided.

8 Claims, 14 Drawing Figures

Fig. 1.
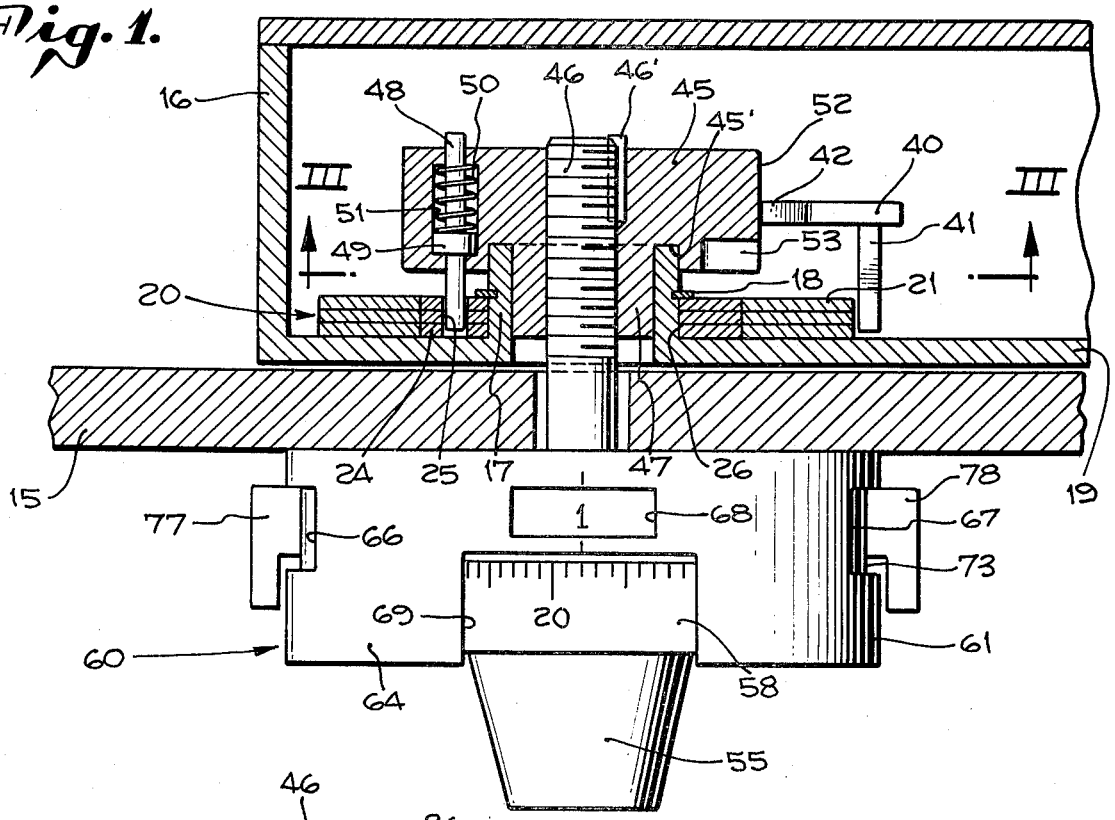
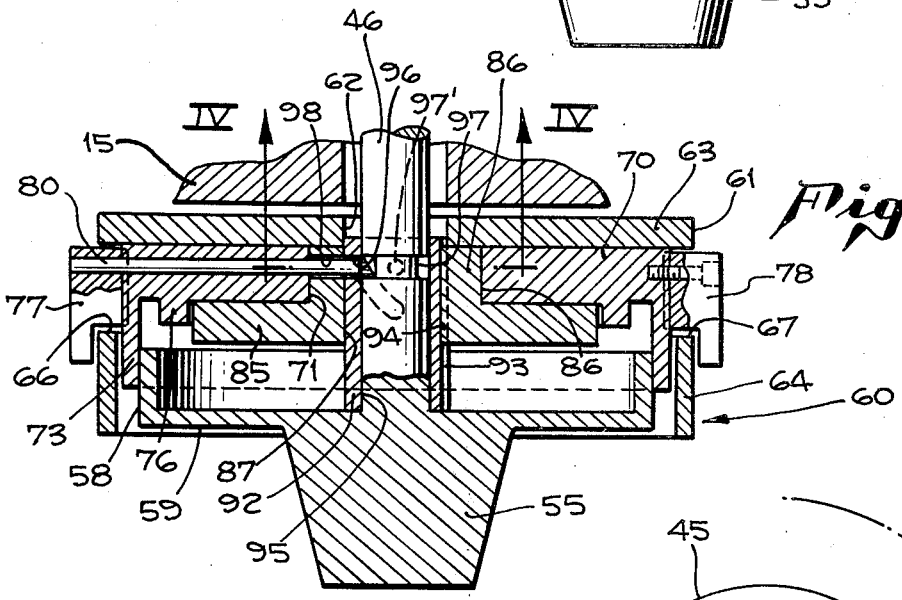
Fig. 2.
Fig. 3.
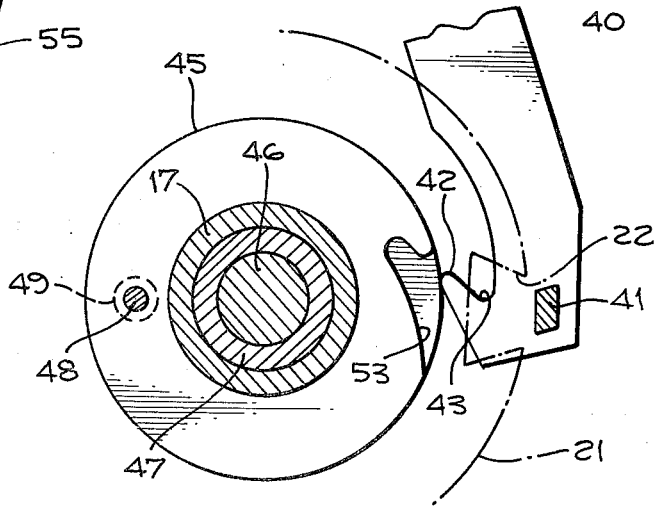
Fig. 4.
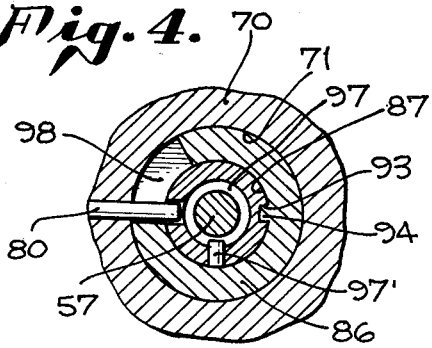

DIRECT-DIAL COMBINATION LOCK

BACKGROUND OF THE INVENTION

This invention relates in general to a direct-dial combination lock wherein rotation of the lock dial directly controls the location of associated tumbler means which must be placed thereby into a predetermined relationship in order to allow opening of the lock. More specifically, the present invention relates to an improvement in such direct-dial combination locks wherein the lock may not be "manipulated" by unauthorized personnel to sensing any interaction between the release lever of the lock and the associated tumbler means driven directly off rotation of the dial.

In traditional combination locks, if the dial is turned beyond any particular number in the combination, the entire sequence of numbers must be redialed. While such arrangements have been intended to make the lock more difficult to "manipulate" by unauthorized personnel, it is somewhat inconvenient to authorized personnel who may accidentally go past a number in the combination and thus has to start over again. It is therefore an object of the present invention to disclose and provide a combination lock which allows for a direct dial of a number in the combination, regardless of which may the dial is turned and regardless of whether the particular number is passed once, twice or more in indexing the number to the otherwise conventional index mark employed in combination locks.

There have been prior attempts to provide such direct-dial combination locks, as for example in the prior U.S. Pat. No. 8,593, wherein a plurality of tumbler discs were mounted for rotation relative to, and blocking movement of the bolt of the lock until gate openings in the tumbler discs were properly aligned to a portion of the bolt. And axially slidable dial means was provided in the aforenoted patent disclosure with a drive pin engaging, and sequentially releasable from each of the tumbler wheels in order to locate and successively release each in a preferred, aligned relation determined by the combination for the lock. However, it was recognized that this direct-dial lock might be "manipulated" by unauthorized personnel due to the possibility of sensing slight engagements between the gate openings of the directly dialed tumbler wheels and the portion of the bolt which the tumbler wheels were blocking until placed in the proper combination or arrangement. The attempted solution in such prior patent was to provide a plurality of false gate openings on each tumbler wheel so that a hopefully false indication of the location of the gate openings would be sensed during unauthorized manipulation of the lock. A more recent, and involved, construction of such direct-dial lock is disclosed in U.S. Pat. No. 2,104,516 employing a plurality of tumbler discs as discussed hereinbefore.

It is therefore another object of the present invention to disclose and provide a direct-dial combination lock construction which is economically constructed and simply operated employing directly dialed tumbler discs or wheels having gate openings therein but which may not be "manipulated" by unauthorized personnel through an attempted sensing of slight engagements between the tumbler wheel gate openings and a portion of the bolt or associated release lever whose movement is to be blocked by the tumbler wheels until they are properly aligned through direct dialing thereof by an associated dial means.

SUMMARY OF THE INVENTION

Generally stated, the present invention in a direct-dial combination lock having a latch operating lever arm movable between latch open and latch close positions includes the provision of a plurality of tumbler means for blocking movement of such lever arm to latch open position until they are arranged in a predetermined combination wherein tumbler gate openings are presented toward a portion, or associated member, of the lever arm, a manually operable dial means for locating the tumbler means through manual manipulation of the dial portion thereof and a tumbler locator and lever arm actuator member and means for mounting such member for movement about a central axis in response to manual operation of the dial, to rotate and locate the tumbler means, wherein such member remains normally in abutting contact with the lever arm, or a portion thereof, to prevent contact between the lever arm and tumbler means during locating of the tumbler means, the member also being moved axially to place an interengaging means of the member and lever arm into engagement to thereafter move the lever arm toward a release position, the lever arm portion or associated means then entering the tumbler gate openings if they have been properly aligned in accordance with the combination for the lock.

A more complete understanding of the present invention, as well as an appreciation for additional objects and advantages thereof, will be afforded to those skilled in the art from a consideration of the following detailed description of preferred and alternative exemplary embodiments thereof. Reference will be made to the appended sheets of drawings whose figures will be initially briefly described.

BRIEF DESCRIPTION OF THE DRAWINGS

FIG. 1 is a plan view, partially in section, of a preferred exemplary embodiment of the combination lock in accordance with the present invention;

FIG. 2 is a horizontal section view of the dial and associated mechanisms of the combination lock exteriorly of wall 15 in FIG. 1;

FIG. 3 is a detail view, partially in section, of the combination lock of FIG. 1 taken therein along the plane III—III;

FIG. 4 is a detail section view of the combination lock of FIGS. 1 through 3 taken in FIG. 2 along the plane IV—IV;

DETAILED DESCRIPTION OF PREFERRED EXEMPLARY EMBODIMENT

Figures 5, 6, 7:
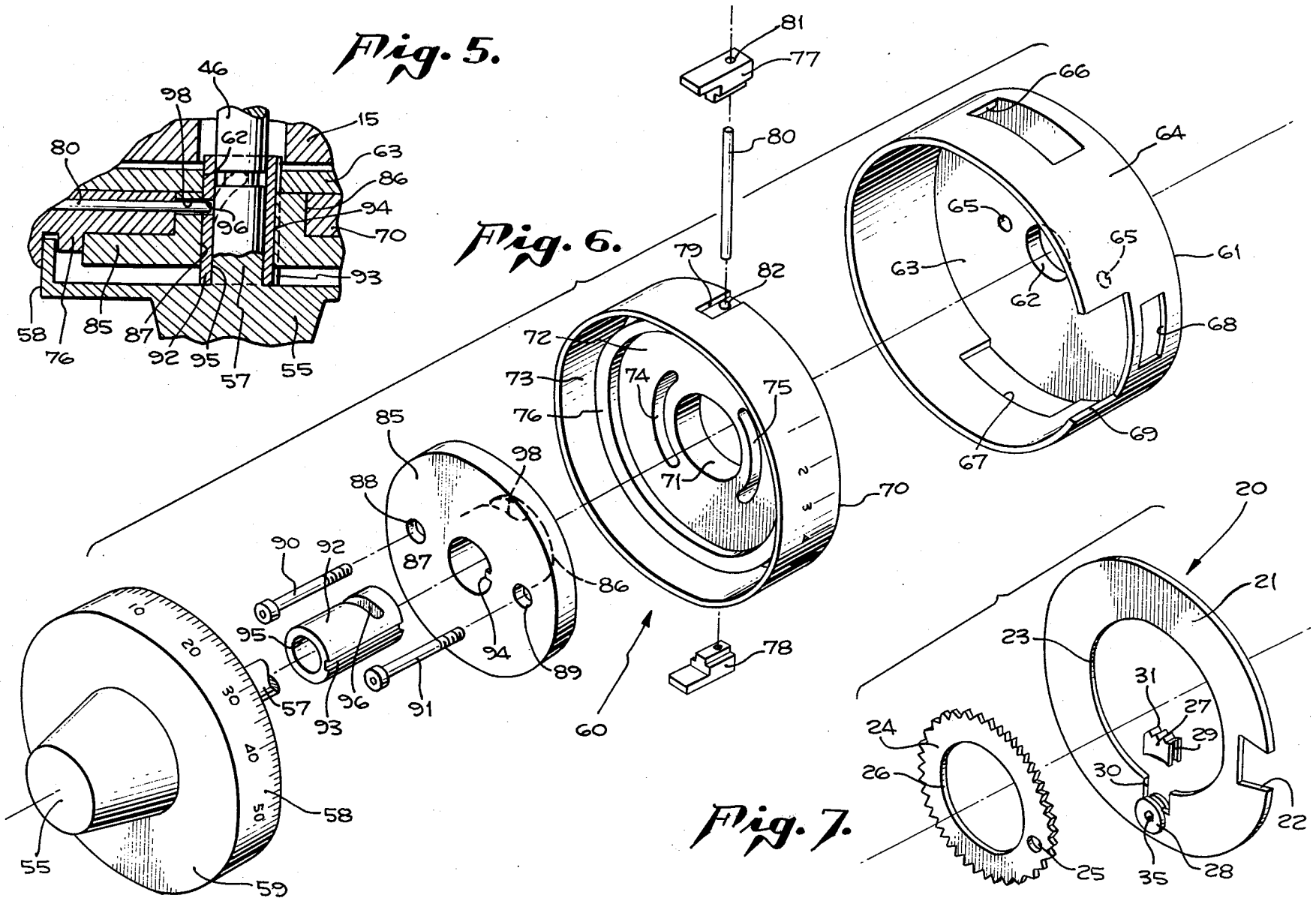
FIG. 5 is a detail section view as in FIG. 2 with portions thereof axially adjusted relative to their positions of FIG. 2.
FIG. 6 is an exploded view of the dial and dial associated mechanism of FIG. 2.
FIG. 7 is an exploded view of an exemplary tumbler means employed in the combination lock of FIG. 1.

Referring now to FIG. 1, the preferred exemplary embodiment of combination lock, according to the present invention, is shown mounted to a wall 15 which is representative of the door of a safe or security room, or portions of a wall adjacent such doors with the dial and dial associated mechanism on a forward side of the wall and the tumbler means, latch release lever and associated actuator means located on the interior side of the wall within a housing 16 as more fully explained hereinafter. In the exemplary embodiment, interior lock housing 16 is provided with an integrally formed inwardly extending bushing or boss 17 about which the tumbler means, indicated generally at 20, may be mounted and retained by a split ring retainer 18 generally adjacent the interior front wall 19 of the housing.

Tumbler means are provided in the preferred exemplary embodiment, indicated generally at 20, in the form of a plurality of wheels or discs of otherwise conventional construction which are separated in known manner by appropriate shims (not shown). Such tumbler wheels or discs, as known heretofore in the art, and as best seen in FIGS. 7 and 9 through 11, may comprise a gate ring 21 having an opening or gate 22 formed in the outer periphery thereof and presenting an inner, central aperture 23 which receives a drive ring 24. Drive ring 24 is provided with a drive pin aperture 25, to be driven by a pin associated with the tumbler locator and lever arm actuator member described hereinafter, and has an inner aperture 26 adapted to fit about the aforedescribed bushing or boss 17 formed in inner housing 16.

Also as known heretofore in the art, the relative positioning of each individual gate ring 21 and associated drive ring 24 may be varied in order to change the "combination" for the lock. Exemplary of means for accomplishing such adjustment are the illustrated locking pawl 27 and associated cam spool 28 as best seen in FIGS. 7 and 9 through 11. Pawl 27 is provided with side splines, as spline 29 in FIG. 7, which fit over marginal portions of slot 30 formed in ring 21. Pawl teeth 31 are provided to engage with drive teeth 24′ of drive ring 24 when the associated spool 28 is rotated, as hereinafter described, relative to the base web 32 formed at the lower end of pawl 27 by arcuate cut-outs on either side thereof.

Figure 10:
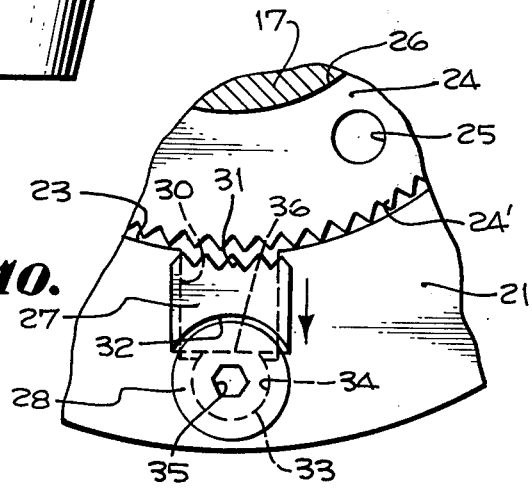
FIG. 10 is a detailed view as in FIG. 9.
Figure 9:
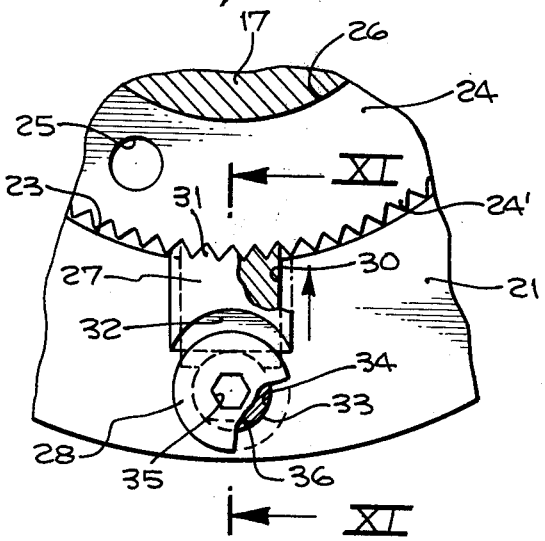
FIG. 9 is a detail view of a portion of the exemplary tumbler means of FIG. 7.
Figure 11:
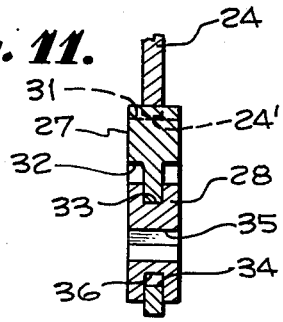
FIG. 11 is a section view of the detail view of FIG. 9 taken therein along the plane XI—XI.

As best seen in FIG. 11, the camp spool 28 has a circumferential slot 33 which fits onto marginal portions of square aperture 34 formed in drive ring 21 and has a hex-head center opening 35 to facilitate its manual rotation through the use of a special change key having a hex shape cross-section. A flat 36 is provided circumferential slot 33 on the inner reduced diameter of the spool such that when it is aligned to the underside of pawl 27, as seen in FIG. 10, relative rotation of the drive ring and tumbler ring may be accomplished. However, once a desired orientation is achieved between the two rings, turning cam spool 28 will engage pawl 27 against the drive ring teeth 24′ holding the two together for concurrent rotation, as seen in FIG. 9.

Figure 8:
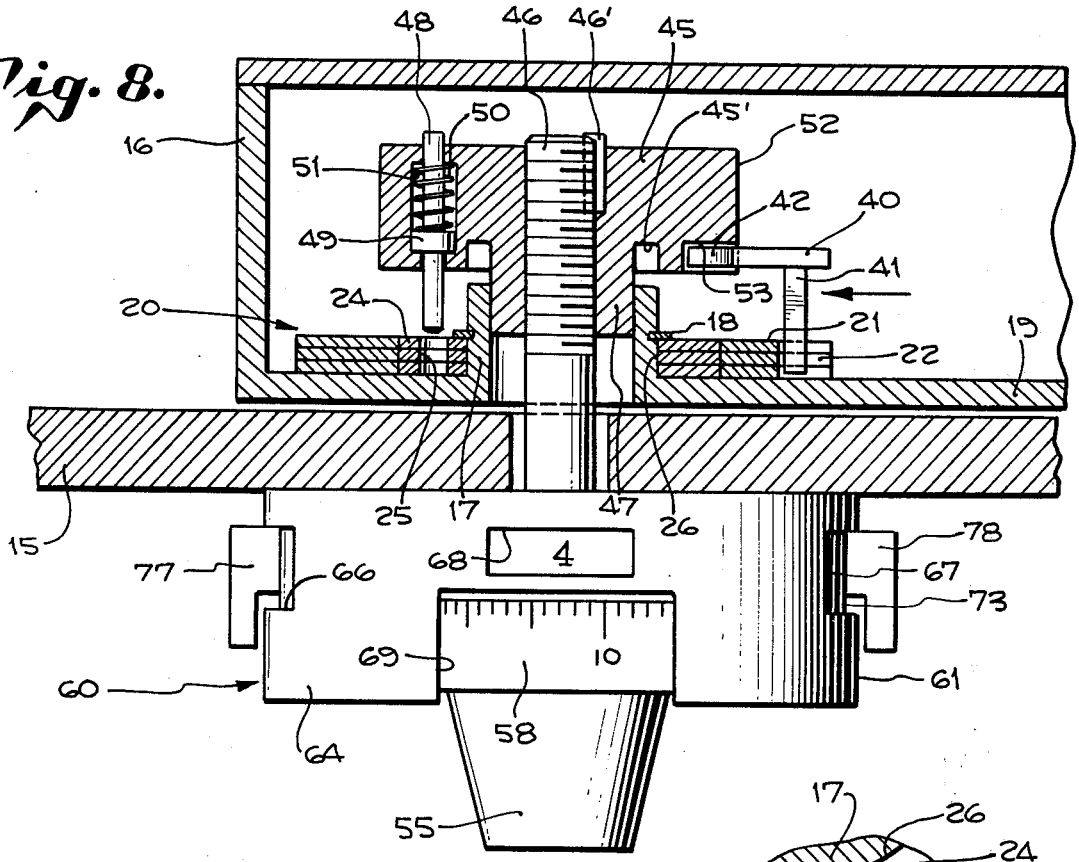
FIG. 8 is a plan view, partially in section, as in FIG. 1 with portions thereof axially adjusted relative thereto as compared to the position of FIG. 1.

The aforedescribed tumbler means, indicated generally at 20, is thus adapted to be rotated about the bushing or boss portions 17 within chamber 16, by actuator means hereinafter described, in order to align the respective gate openings to one another, as seen in FIG. 8, so that an associated latch release lever 40 may be moved to a latch release position, also seen in FIG. 8.

Latch release lever 40 is provided with a laterally extending gate bar 41, adapted to enter the aligned gate openings 22 of the tumbler means when properly orientated. Further, as best seen in FIG. 3, the release lever 40 has a nose 42, forming a nose recess 43, which is adapted to ride along a smooth exterior surface of the lever arm actuator member 45 and be actuated thereby. Spring means may be provided for normally biasing lever 40 toward the member 45.

As particularly contemplated within the present invention, tumbler locator and lever arm actuator means are provided for not only engaging and sequentially locating and releasing the individual tumbler wheels or rings of the aforedescribed tumbler means, indicated generally at 20, but also for continuously maintaining lever 40 in a manipulation proof relation to the tumbler means such that the lock construction of the present invention may not be opened, or "manipulated", by unauthorized personnel. In the preferred exemplary embodiment, such means comprise the provision of the tumbler locator and lever arm actuator member 45 as best seen in FIGS. 1 and 2. Member 45 is of a generally cylindrical block configuration with a central threaded bore therethrough by which it is adjustably positioned and then pinned to drive shaft 46. The assembled locator and actuator member 45 and drive shaft 46 are rotatably mounted with housing 16 via the provision of an integrally formed sleeve portion 47 which fits within bushing or boss 17 of the housing, the inner free end of bushing 17 being received in a mating annular groove 45′ formed in member 45.

Tumbler engaging means are provided on the exemplary locator and lever arm actuator member 45 for driving or rotating each tumbler wheel or ring of the exemplary tumbler means into a desired position determined by the combination selected by the lock. In the exemplary embodiment, such means comprise the provision of drive pin 48, adapted to fit into the respective drive pin apertures, as aperture 25, of the drive rings 24. Drive pin 48 is resiliently mounted to member 45 through the provision of a flange portion 49 against which a compression spring 50 acts within a chamber 51 provided in member 45 as seen in FIGS. 1 and 8. Such resilient mounting for drive pin 48, as more fully explained hereinafter, facilitates the pick-up or interengagement of the pin and respective drive rings during their setting of the lock preparatory to initiating and unlocking operation of the preferred exemplary embodiment. As will also be explained in more detail hereinafter, the drive shaft 46 is associated with the dial of the combination lock such that manipulation of the dial will locate each tumbler wheel or ring successively as the drive pin and associated member 45 are adjusted axially from the position of FIG. 1 to the position of FIG. 8 in operating the lock.

In addition to engaging and locating the tumbler means, as in part explained hereinbefore, the member 45 is provided with a smooth cylindrical exterior surface 52 against which lever 40 rides during locating of the tumbler means through operation of dial 57. As can be seen in FIG. 1, nose 42 of lever 40 rides against the smooth cylindrical exterior surface 52 of member 45 on initiation of operation of the lock; lever mounted gate bar 41 being held in spaced relation relative to the individual tumbler wheels or rings of the tumbler indicated generally at 20. However, when the individual tumbler rings have been oriented as in FIG. 8, and the member 45 has been moved axially to the position of FIG. 8, as explained hereinafter, the nose 42 of latch release lever 40 is aligned to means, comprising a recess 53, on member 45 for interengaging with the nose 42 of the lever arm to move the latter upon further turning of the drive shaft 46 by the associated dial 55. The engaged condition is illustrated in FIG. 8.

As seen in FIG. 2, dial 55 includes an inner, intergrally formed annular ring 58 and generally planer intergral web portion 59. As seen in FIG. 1, the outer annular ring 58 may be provided with appropriate indicia to indicate the position of rotation of dial 55 to facilitate dialing a particularly predetermined combination for the lock.

Means are provided for both rotating and axially moving the tumbler locator and lever arm actuator member 45 in the exemplary embodiment in order to carry out the tumbler locating, release and lever arm interengaging operations discussed hereinbefore. Referring specifically to FIG. 2, such means include the provision of means for mounting drive shaft 46 for axially slideable as well as rotative movement. Rotation of dial 55 is thus transmitted directly through integral drive shaft portion 46 to member 45 for movement about its central axis in response to manual operation of dial 55. As seen in FIG. 2, dial 55 includes an inner, intergrally formed annular ring 58 and generally planer intergral web portion 59. As seen in FIG. 1, the outer annular ring 58 may be provided with appropriate indicia to indicate the position of rotation of dial 55 to facilitate dialing a particularly predetermined combination for the lock. Means are also provided for selectively adjusting the axially position of member 45 to facilitate disengaging drive pin 48 from the pin aperture 25 of each of the tumbler wheels 21 after their rotation into the desired release position of FIG. 8. In the exemplary embodiment, such means comprise axially adjusting means, indicated generally at 60, in FIGS. 1, 2, 8 and particularly in the exploded view of FIG. 6. Such adjusting means includes the provision of housing 61, cam actuator body 70, retainer body 85, and camming sleeve 92 as hereinafter explained.

Housing 61, as best seen in the exploded view of FIG. 6, includes an inner bore 62 through which drive shaft 46 passes (FIGS. 2 and 5), a backwall 63 and cylindrical sidewall 64. The housing is provided with screw holes through the backwall, as screwhole 65, to facilitate mounting of the housing to wall 15. Apertures 66 and 67 are provided in the cylindrical side wall to allow movement of the enclosed cam actuator body as hereinafter described. In addition, a view aperture 68 is provided for viewing a position indicator, as hereinafter described, generally adjacent to a view slot 69 to facilitate viewing of the indicia provided upon dial ring or side wall 58.

Cam actuator body 70, as best seen in FIG. 6, is provided with a central aperture 71 formed in web 72. A cylindrical side wall 73 is provided, having a smaller external diameter than the internal diameter of housing 61 to fit therein. Arcuate slots 74 and 75 in web 72 facilitate the mounting of cam actuator body 70 within housing 61 for limited relative rotation as allowed by the extent of said slots when said body and housing are assembled with appropriate fasteners or screws 90 and 91 as hereinafter explained.

An internal ring boss 76 is provided in the exemplary embodiment of cam actuator body for receiving the retainer body 85, as seen in FIG. 2. In addition, the cylindrical side wall 73 of body 70 is provided with a pair of opposed recesses, as recess 79 for receiving thumb pads 77 and 78. Thumb pads 77 and 78 may be mounted to body 70 by conventional fasteners, as seen in FIG. 2. Thumb pads 77 and 78 are preferably secured to the cam actuator body, after preassembly of body 70 within housing 61, the thumb pads protruding through apertures 66 and 67, respectively, facilitating rotation of body 70 through manipulation of the pads.

Retainer body 85 is provided with an integrally formed laterally extending boss or bushing portion 86 which fits within aperture 71 of body 70 in a relatively rotatable fit. Retainer body 85 in turn has a center bore 87 within which camming sleeve 92 is positioned. Apertures 88 and 89 in retainer body 85 are provided to receive fasteners, i.e. screws, 90 and 91 therethrough. As seen in FIG. 6, retainer body 85 may be mounted in stationary, spaced relation to housing 61, by passing fasteners 90 and 91 through apertures 88 and 89 of the retainer body 85 and apertures 65 of housing 61 and into the mounting wall 15. Fasteners 90 and 91 also pass through the arcuate slots 74 and 75 of the inner-disposed relatively rotatable cam actuator body 70.

Camming sleeve 92 is provided with an exterior configuration facilitating its insertion into central aperture or bore 87 through the bushing or boss portion 86 and aperture 62 of housing 61, as seen in FIG. 5. A key slot 93 is formed in the exterior of camming sleeve 92 to slide over the keyway 94, projecting inwardly of bore 87, to facilitate relative axial movement of camming sleeve 93 relative to retainer body 85, cam actuator body 70 and housing 61 while preventing relative rotation. The inner bore 95 of camming sleeve 92 is provided to fit about shaft 57 of dial 55. Shaft 55 is provided with a circumferential groove 97 into which a pin 97' (through camming sleeve 92) fits to allow only relative rotation, but not axial movement between sleeve 92 and shaft 57.

Cam engaging dowel or pin 80, as seen in FIG. 5, extends through web 72 of cam actuator body 70 and into a curved cam slot 96 formed in sleeve 92. From the foregoing, it can be seen that upon rotation of cam actuator body 70, camming sleeve 92 and dial 55 are moved axially due to the sliding engagement of the dowel or pin 80 in slot 96, i.e. since dowel or pin 80 is moved in an arc about the central axis of camming sleeve 92, the interengagement between pin 80 and the camming slot 96 causes axial translation of camming sleeve 92. On movement of the camming sleeve from the position of FIG. 2 to the extended position of FIG. 5, by a full clockwise rotation of cam actuator body 70 via thumb pads 77 and 78, drive shaft 46 is axially moved from the position of FIG. 2 to that of FIG. 5 and member 45 is axially moved from the initial position of FIG. 1 to the release position of FIG. 8.

During the transitory positioning of member 45, its drive shaft 46, and camming sleeve 92 through the aforedescribed rotation of the cam actuator body, the tumbler drive pin 48 is sequentially withdrawn from the individual drive rings 24 of the tumbler means. Indicia may be placed on the periphery of cylindrical side wall 73 which is visible through the viewing aperture 68 in order to locate certain desired rotative positions for body 70. As seen in FIG. 1, the number 1, provided upon the exterior surface of cylinder 73 of body 70, indicates the initial position for the lock mechanism wherein cam actuator body is rotated fully clockwise and member 45 is in its most forward position, indicated in FIG. 1, wherein drive pin 48 is in interengagement with each of the plurality of tumbler means drive rings 24. The length and angular inclination of slot 96 relative to its central axis may be easily determined by the desired axial travel required for member 45 from the positions of FIG. 1 to that of FIG. 8 under the arcuate rotation of drive body 70 within the limits allowed by arcuate slots 74 and 75 relative to stationary fasteners 90 and 91 as aforedescribed.

Intermediate positions 2 and 3 may be indicated on the periphery of cylinder wall 73 at the locations of axial adjustment where member 48 is moved vertically in FIG. 1 to successively release the first and second tumbler wheels, successively. Position 4, illustrated in FIG. 8, corresponds to the axial adjustment of member 45 to release all of the tumbler means from interengagement with drive pin 48 and to align the recess 53 on the inner end of member 45 with nose 42 of latch release lever 40. On such alignment, due to the spring bias provided for lever arm 40, an interengagement will occur between the mating portions of lever 40 and member 45 such that further rotation of dial 55 in a counterclockwise direction will cause operation of the associated latch or bolt to a release position. Through counterclockwise rotation of cam actuator body 70, member 45 may be returned to the start position of FIG. 1. On the return of member 45 the drive pin 48 merely backs off within member 45, under the bias of its spring 50, upon engagement with the rear face of the inner most tumbler wheel until pin 48 successively aligns with and enters each of the drive pin apertures 25, upon an initial rotation of member 45 via dial 55.

Alternative Exemplary Embodiment

Figure 12:
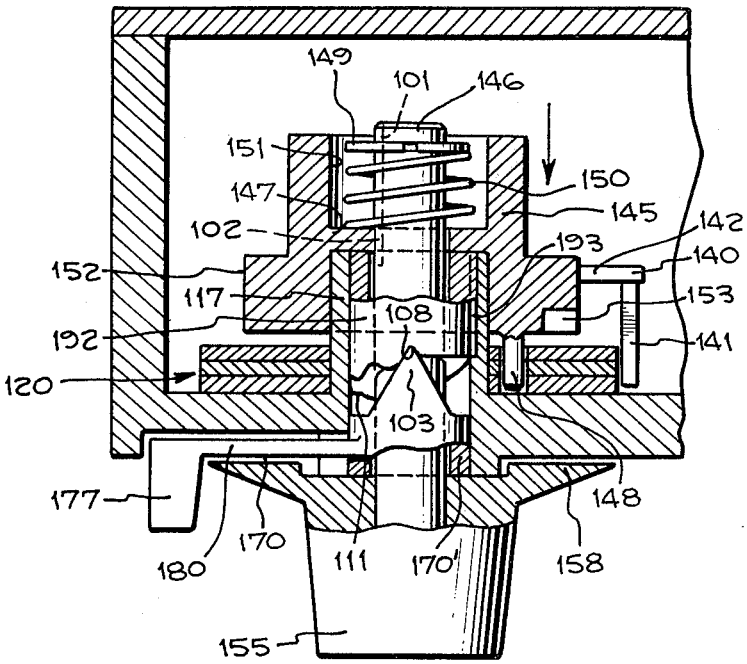
FIG. 12 is a plan view, partially in section, of an alternative exemplary embodiment of combination lock in accordance with the present invention.
Figure 14:
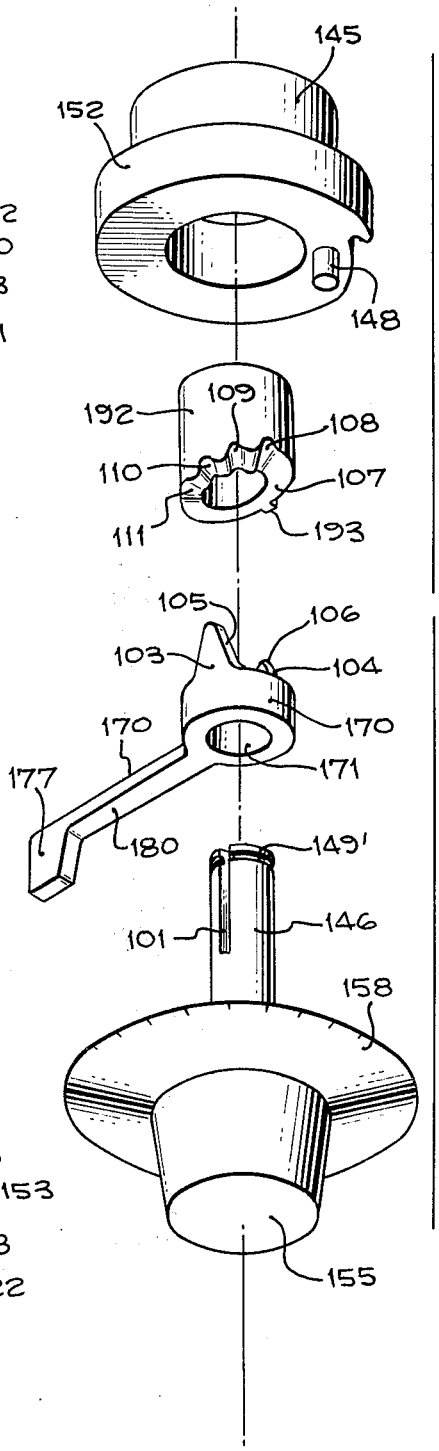
FIG. 14 is a exploded view of portions of the alternative exemplary embodiment of lock of FIGS. 12 and 13.
Figure 13:
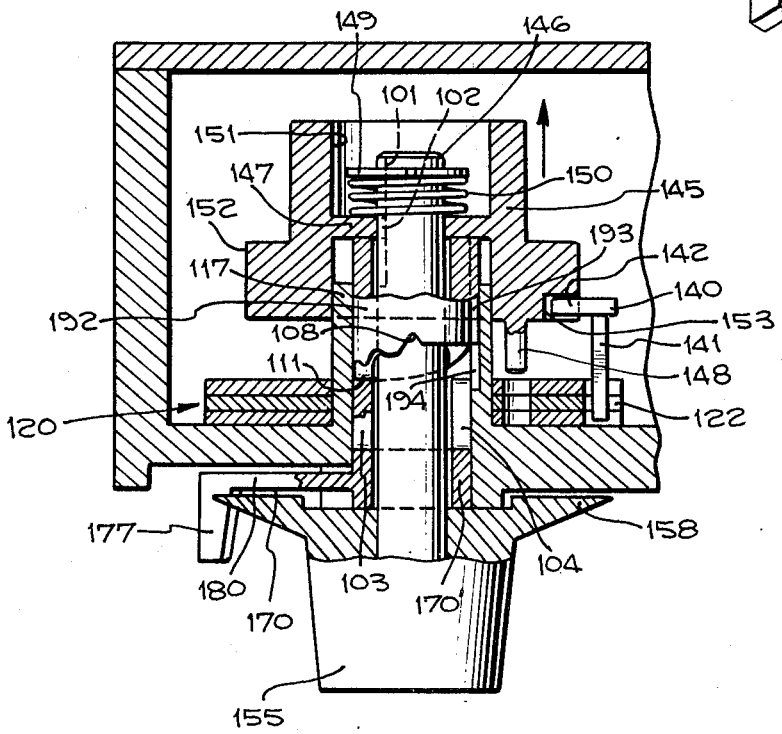
FIG. 13 is a view as in FIG. 12 with portions thereof axially adjusted relative to one another as compared with their positions in FIG. 12.

Referring now to FIGS. 12 through 14, an alternative exemplary embodiment of the combination lock in accordance with the present invention will be described. As seen in FIGS. 12 and 13, the alternative exemplary embodiment of tumbler locator and lever armactuator member 145 is mounted to its drive shaft 146 in a resilient manner via the provision of compression spring 150 positioned between a retainer ring 149, secured on shaft 146, and the inner end of chamber 151 formed in member 145. As seen in the exploded view of FIG. 14, drive shaft 146 is secured directly to dial 155 which has an indicia bearing dial flange 158. The free end of drive shaft 146 is provided with a circumferential notch 149' to receive the string retainer ring 149 thereon, the latter comprising a spreading or snap ring. A spline 101 may be provided in an axial direction along the exterior of drive shaft 146 from its free end, as seen in FIG. 12, to receive a keyway 102 formed in the web 147 of member 145 to provide for a relatively nonrotatable, but axially adjustable, interconnection between the shaft 146 and member 145. Therefore, manual rotation of dial 155 will produce a concurrent rotation of member 145 to facilitate locating the associated tumbler means indicated generally at 120.

In the alternative exemplary embodiment, drive pin 148 is formed integrally of the tumbler locator and lever arm actuator member 145, a resilient mounting of drive pin 148 being provided through the resilient mounting of member 145 upon drive shaft 146 via spring 150.

As in the preferred exemplary embodiment, the member 145 is provided with a cylindrical portion having a smooth exterior surface 152 which engages with the nose 142 of latch release lever 140. Release lever gate bar 141, also as before, is provided to allow operation of the release lever 140 only when the tumbler means, indicated generally at 120, are properly aligned to present their gate openings 122 toward bar 141, receiving the same, as seen in FIG. 13. Until member 145 is moved into the position of FIG. 13, nose 142 of lever arm 140 rides upon the smooth surface 152, preventing manipulation of the lock, as aforedescribed. Recess 153 in member 145 is provided, as before, for interengaging the latch release lever 140 when the lock parts are positioned in the axially adjusted position of FIG. 13.

The means for selectively adjusting the axial position of member 145 in the alternative exemplary embodiment comprises the provision of a camming member 170 and camming sleeve 192. Camming member 192 is of cylindrical configuration and is adapted to fit about drive shaft 146 within the housing bushing 117 as seen in FIGS. 12 and 13. The inner free end of bushing 192 abuts beneath web 147 of member 145 to move it vertically, from the position of FIG. 12 to that of 13 when operated by the camming means 170. Sleeve 192 is provided with a keyway 193 which rides within a spline 194 formed on the interior of bushing 117. The camming bushing 192 is therefore constrained against rotation within bushing 117, but is free to be moved axially therein.

Cam actuator means 170, as best seen in FIG. 14, comprises a body 170' having an inner aperture 171 and a pair of projections 103 and 104 providing camming surfaces 105 and 106 respectively. These latter surfaces engage upon stepped cam surfaces provided on the inner end 107 of sleeve 192 to move it in an axial progression in response to a rotative progression of body 170'. The latter is easily rotated through such progression of positions through manual operation of tab 177 on the end of the arm portion 180 of the camming means.

Referring to FIGS. 12 and 14, in the initial position of the lock mechanism with drive pin 148 engaging the tumbler means, the projections 103 and 104 have their cam surfaces 105 and 106, respectively, engaging mating cam depressions, as cam depression 108, formed in the cam surface 107 of sleeve 192. On a first counterclockwise rotation of camming means 170, the cam projections 103 and 104 will each rotate into the next step of cam depressions, such as cam depression 109, moving cam member 192 axially to displace member 145 and move drive pin 148 out of engagement with the first tumbler wheel of the tumbler means indicated generally at 120. Two additional stages of cam depressions are provided, as cam depressions 110 and 111 so that upon a full counterclockwise rotation of camming means 170 into the position of FIG. 13, the cam projection 103 will have moved progressively into engagement with the third and fourth camming depressions 110 and 111, respectively, until reaching the position of FIG. 13 wherein member 145, and its associated drive pin 148, have been released from the tumbler means and the member recess 153 is aligned to the nose 142 of release lever 140 preparatory to moving the lever and opening the lock. It is to be understood that camming sleeve 192 is symmetrical in that it has two sets of the camming depressions, mating with the two cam projections 103 and 104 of body 170', although only a first set thereof is illustrated in FIGS. 12 through 14.

Having thus described a preferred exemplary embodiment of combination lock in accordance with the present invention, and alternative exemplary embodiment thereof, which should be appreciated by those skilled in the art that the foregoing objects are attained by the present invention. Further, it should be appreciated that the within exemplary embodiments are intended to be exemplary only and that various modifications, alterations and adaptations thereof may be made within the scope of the present invention which is defined by the following claims.

I claim:

1. In a combination lock having a latch operating lever arm movable between latch open and latch closed positions, a plurality of tumbler means for blocking movement of said arm to latch open position until moved into predetermined positions wherein tumbler gate openings are presented toward a part of said arm and a manually operable dial means for locating said tumbler means through manipulation of a dial portion thereof and for actuating said lever arm after locating of said tumbler means, the improvement comprising the provision of:

a tumbler locator and lever arm actuator member and means for mounting said member for movement about a central axis in response to manual operation of said dial, said member having means for engaging and moving said tumbler means on operation of said dial and a portion positioned by said mounting means to be normally in relatively movable abutting contact with said lever arm to prevent contact between said arm and said tumbler means during locating of said tumbler means by said member; and means for selectively adjusting the axial position of said member for sequentially locating and disengaging said tumbler means engaging means from each of said plurality of tumbler means.

2. The improvement in combination lock of claim 1 comprising:

means on said member for interengaging with said lever arm to move the latter upon turning of said dial after locating of said tumbler means and an axial movement of said member by said adjusting means to disengage said member from said tumbler means and align said interengaging means to said lever arm.

3. The improvement in combination lock of claim 2 wherein said tumbler means include a plurality of gated discs mounted for rotation relative to said lever arm and said tumbler locator and lever arm actuator member comprises:

a cylindrical body having a generally smooth exterior surface, providing said member portion, normally in abutting contact with said lever and a shoulder adjacent one end for interengaging with a mating part on said lever arm.

4. The improvement in combination lock of claim 1 wherein said lock includes a housing and said means for selectively adjusting the axial position of said member comprises:

a manually movable arm means exteriorly of said housing; and camming means for converting manual movement of said arm means into axial movement of said member.

5. A direct-dial combination lock comprising:

a plurality of tumbler wheels, each having a central aperture, a drive pin receiving aperture spaced radially outwardly of said central aperture and a single gate opening formed in a periphery thereof;

bushing means having a cylindrical exterior received in said central apertures of said tumbler wheels for mounting them for rotation about a central axis thereof, said bushing means also having a central bore therethrough;

shaft means extending through said bore and including a pair of relatively telescoping shaft portions arrange for unitary rotation;

dial means secured to one of said shaft portions and a tumbler wheel actuator member secured to the other of said shaft portions, said dial means and tumbler wheel actuator member being thereby jointly rotatable and axially adjustable relative to one another, said member having a drive pin means for engaging in said tumbler wheel drive pin apertures; and adjustment means for adjusting the axial position of said actuator member relative to said dial means and tumbler wheels, whereby said tumbler wheels may be sequentially located and released in desired locations by rotation of said member by said dial means and axial adjustment of said member relative to said wheels by operation of said adjustment means.

6. A direct-dial combination lock as in claim 5 wherein:

said adjustment means includes a manually engagable tab located in the vicinity of said dial means to facilitate the sequential operation of said member to locate and release said tumbler wheels through operation of said dial means and tab.

7. A direct-dial combination lock comprising:

a plurality of tumbler means having a single gate opening on each such means and being mounted for rotation relative to a latch release bar adapted to enter the gate openings when aligned in order to allow opening of the lock;

a dial means on one side of said plurality of tumbler wheels and a tumbler wheel actuating member on the opposite side of said wheels with shaft means operably connecting said dial means and actuator means for concurrent rotation and relative axial adjustment; and means on said actuator means for normally blocking movement of said release bar toward said tumbler wheel gate openings, but allowing the same when said actuator means is moved axially a given distance.

8. A direct-dial combination lock as in claim 7 wherein:

adjustment means are provided for selectively adjusting the axial location of said actuator member relative to the tumbler wheels.

* * * * *